United States Patent [19]

Egnell et al.

[11] 4,145,178

[45] Mar. 20, 1979

[54] METHOD AND APPARATUS FOR DECREASING NITROGEN OXIDES AND UNBURNT HYDROCARBONS WHEN BURNING HYDROCARBON FUELS

[75] Inventors: Rolf A. Egnell, Genarp; Mats I. Moritz, Trelleborg, both of Sweden

[73] Assignee: Kommanditbolaget United Stirling (Sweden) AB & Co., Malmo, Sweden

[21] Appl. No.: 803,723

[22] Filed: Jun. 6, 1977

[30] Foreign Application Priority Data

Jun. 24, 1976 [GB] United Kingdom ..... 26230/76

[51] Int. Cl.[2] ..... F23D 11/44

[52] U.S. Cl. ..... 431/11; 431/8; 431/215

[58] Field of Search ..... 122/240 A, 240 B; 431/2, 8, 10, 11, 215

[56] References Cited

U.S. PATENT DOCUMENTS

| | | | |
|---|---|---|---|
| 2,968,288 | 1/1961 | Zoschak et al. | 122/240 B |
| 3,048,131 | 8/1962 | Hardgrove | 431/11 X |
| 3,865,084 | 2/1975 | DePoister | 431/10 X |
| 3,948,223 | 4/1976 | Benson | 431/10 X |

*Primary Examiner*—Edward G. Favors

*Attorney, Agent, or Firm*—Laurence R. Brown

[57] ABSTRACT

Fuel is burned in two chambers, the first with excessive air to produce combustion gases containing oxygen and the second using cooled combustion gases from the first to constitute the oxidizing medium. Preferably the proportions of fuel in the two chambers are equal and the combustion gases are cooled to about 800° C.

8 Claims, 3 Drawing Figures

METHOD AND APPARATUS FOR DECREASING NITROGEN OXIDES AND UNBURNT HYDROCARBONS WHEN BURNING HYDROCARBON FUELS

This invention relates to a method and an apparatus for burning fuel containing hydrocarbon compounds.

BACKGROUND OF THE INVENTION

It is well known that combustion of hydrocarbon fuels with atmospheric air will cause formation of nitrogen oxides if excess of air is used and if high temperatures are reached during the combustion.

A decrease of the air-fuel ratio may cause formation of unburnt hydrocarbons and carbon monoxide which are lost in the exhaust gases and thus cause a substantial loss of potential energy. Lowering the combustion temperature by water injection is very effective regarding reduction of nitrogen oxide formation, but will also involve loss of energy. Recirculation of exhaust gases is effective and involves only slight loss of energy, but requires specially governed valve systems.

OBJECT OF THE INVENTION

One object of the present invention is to provide a method and an apparatus for burning fuel containing hydrocarbon compounds, employing a low overall ratio between air and fuel with a view to obtaining low contents of unburnt hydrocarbons and carbon monoxide in the exhaust gases, low emissions of nitrogen oxides, and a good fuel economy.

BRIEF DESCRIPTION OF THE INVENTION

According to the invention there is employed a method of burning fuel containing hydrocarbon compounds, comprising the following steps:

(a) burning a first proportion of the fuel in a first combustion chamber with a substantial excess of atmospheric air to produce first combustion gases containing oxygen, (b) cooling said first combustion gases, (c) burning a second proportion of the fuel in a second combustion chamber using the cooled first combustion gases as the sole or substantially sole oxidizing medium.

Preferably said first proportion and said second proportion of the fuel are substantially equal to one another, and with advantage said first combustion gases are cooled to a temperature within the range 750° C. to 850° C. before passing into the second combustion chamber.

The said substantial excess of air may amount to between 2 and 2.5 times the minimum quantity of air theoretically required for complete burning of said first proportion of the fuel, and the air may be preheated to a temperature within the range 650° C. to 750° C. before passing into the first combustion chamber.

In a preferred method exhaust gases from the second combustion chamber are used in a heat-exchanger for preheating the atmospheric air.

It is advantageous if all the combustion gases from the first combustion chamber are used as the oxidizing medium in the second combustion chamber, and there is further advantage if the combustion gases used as the oxidizing medium in the second combustion chamber contain free oxygen amounting to between 1.2 and 1.3 times the minimum quantity of oxygen theoretically required for complete burning of said second proportion of the fuel.

For effecting the method the invention provides an apparatus comprising in combination means for producing a flow of atmospheric air, a first heat-exchanger for preheating said flow of air, a first combustion chamber with means for burning therein a first proportion of said fuel with a substantial excess of said air to produce first combustion gases containing oxygen, a second heat-exchanger for cooling said first combustion gases, a duct for conveying the cooled first combustion gases to a second combustion chamber, means for burning a second proportion of the fuel in the second combustion chamber using the cooled first combustion gases as the sole or substantially the sole oxidizing medium, and a conduit for conveying exhaust gases from the second combustion chamber to the first heat-exchanger.

There may be means for introducing into the two combustion chambers substantially equal mass flows of the fuel, the latter being fluid.

THE DRAWING

How the invention may be put into practice is described in more detail with reference to the accompanying drawing, in which:

FIG. 1 is a graph, not to scale, approximately indicative of the contents of nitrogen oxides in the exhaust gases as a function of the air excess fuel ratio, FIG. 2 is a graph, not to scale, approximately showing the contents of nitrogen oxides and carbon monoxide as a function of the amount of recirculated exhaust gases, and FIG. 3 schematically shows an apparatus according to the invention.

DETAILED DESCRIPTION OF THE INVENTION

Figure 1:
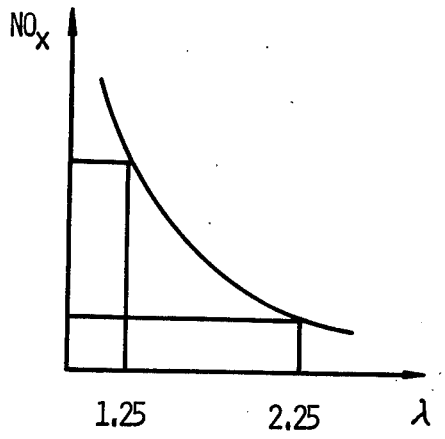
Figure 2:
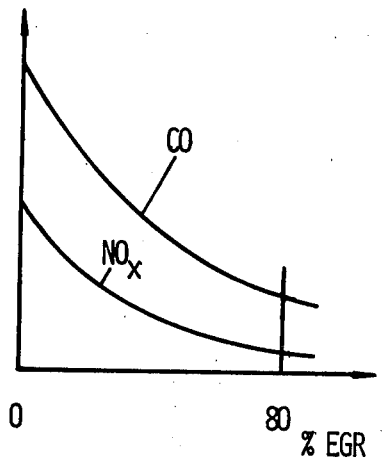

Normally combustion of a hydrocarbon fuel is carried out with about 25% excess of air, then the air excess fuel ratio lambda is 1.25. However, the air excess fuel ratio may be substantially higher — e.g. lambda may be 2.25, resulting in more than five times smaller contents of nitrogen oxides, as will be evident from FIG. 1 depicting the amount of nitrogen oxides ($NO_X$) in the exhaust gases as a function of the excess of air preheated to about 700° C. However, recirculated exhaust gases may be mixed with the air, and FIG. 2 shows curves indicative of the amounts of CO and $NO_X$ in the exhaust gases in dependence upon the contents of exhaust gases EGR in the combustion air, the curves depicting said functions under the assumption that the air excess fuel ratio is 1.25.

The invention provides a method of burning fuel containing hydrocarbon compounds, comprising the following steps:

(a) burning a first proportion of the fuel in a first combustion chamber with a substantial excess of atmospheric air to produce first combustion gases containing oxygen, (b) cooling said first combustion gases, (c) burning a second proportion of the fuel in a second combustion chamber using the cooled first combustion gases as the sole or substantially sole oxidizing medium. For example, the combustion gases formed in the first combustion chamber may be cooled in a heat exchanger to about 800° C. and contain sufficient oxygen to be used as combustion air for a subsequent burning of more fuel — so much that in the second combustion chamber the air excess fuel ratio is e.g. 1.125 — i.e. less than the ratio normally used. If the air excess fuel ratio in the first oxidation step is 2.25, the contents of exhaust gases in the combustion air will correspond to 80 percent recirculation of exhaust gas. It will be understood from FIG. 2 that the CO and $NO_X$ contents are greatly reduced.

Figure 3:
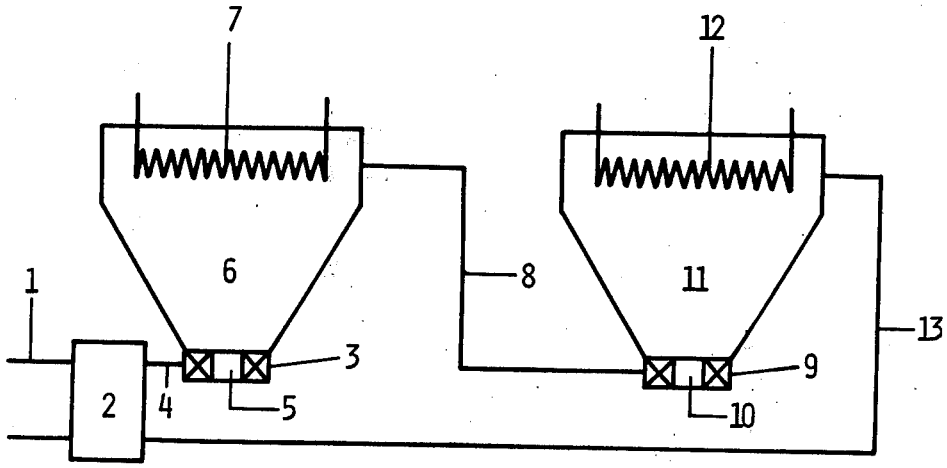

The apparatus shown in FIG. 3 comprises an air supply conduit 1 leading to a preheater heat-exchanger 2 from which it is passed to a burner 3 via a conduit 4. A flow of fuel is supplied to the burner 3 via a conduit 5. The air and fuel react in a first combustion chamber 6 and the heat developed is removed to a great extent by a heat-exchanger 7. The exhaust gases containing a substantial amount of oxygen leave the chamber 6 via a duct 8 and at a temperature of about 800° C.

The said combustion gases are passed to a burner 9, to which fuel is supplied via a conduit 10. Said fuel and the oxygen in the supplied combustion gases react in a second combustion chamber 11. The heat developed in the chamber 11 is to a great extent removed by a heat-exchanger 12, and the exhaust gases will leave the chamber 11 at a temperature of about 800° C. via a conduit 13 leading to the preheater heat-exchanger 2 in which they will give off a substantial part of their heat energy to the air supplied to the heat-exchanger 2 through the supply conduit 1.

Thus, a first proportion of the fuel is burnt in the chamber 6 and a second proportion is burnt in the chamber 11, and the apparatus is operated so that said first proportion and said second proportion of the fuel are substantially equal to one another and that said first combustion gases are cooled to a temperature within the range 750° C. to 850° C. before passing into the second combustion chamber. The above-mentioned substantial excess of air amounts to between 2 and 2.5 times the minimum quantity of air theoretically required for complete burning of said first proportion of the fuel and it is preheated to a temperature within the range 650° C. to 750° C. before passing into the first combustion chamber. Moreover all the combustion gases from the first combustion chamber are used as the oxidizing medium in the second combustion chamber, and the combustion gases used as the oxidizing medium in the second combustion chamber contain free oxygen amounting to between 1.2 and 1.3 times the minimum quantity of oxygen theoretically required for complete burning of said second proportion of the fuel.

The apparatus may comprise means, for example a pump and valves (not shown) for introducing into the two chambers 6 and 11 substantially equal mass flows of the fuel when the latter is a fluid.

What is claimed is:

1. A method of burning fuel containing hydrocarbon compounds, comprising the following steps:

(a) providing at least a first and a second combustion chamber, a heat-exchanger, and atmospheric air for passage into at least one of the combustion chambers, (b) burning a first proportion of fuel in the first combustion chamber with a substantial excess of atmospheric air to produce first combustion gases containing oxygen, (c) cooling said first combustion gases, (d) burning a second portion of fuel in the second combustion chamber using the cooled first combustion gases as the primary oxidizing medium, said first proportion and said second proportion of the fuel being substantially equal to one another, and (e) using the exhaust gases from the last combustion chamber in the heat-exchanger to preheat at least a portion of the atmospheric air for passage into at least one of the combustion chambers.

2. A method of burning fuel containing hydrocarbon compounds, comprising the following steps:

(a) providing at least a first and a second combustion chamber, a heat-exchanger, and atmospheric air for passage into at least one of the combustion chambers.

(b) burning a first proportion of fuel in the first combustion chamber with a substantial excess of atmospheric air to produce first combustion gases containing oxygen, (c) cooling said first combustion gases, said first combustion gases being cooled to a temperature within the range 750° C. to 850° C. before passing into the second combustion chamber, (d) burning a second portion of fuel in the second combustion chamber using the cooled first combustion gases as the primary oxidizing medium, and (e) using the exhaust gases from the last combustion chamber in the heat-exchanger to preheat at least a portion of the atmospheric air for passage into at least one of the combustion chambers.

3. A method of burning fuel containing hydrocarbon compounds, comprising the following steps:

(a) providing at least a first and a second combustion chamber, a heat-exchanger, and atmospheric air for passage into at least one of the combustion chambers, (b) burning a first proportion of fuel in the first combustion chamber with a substantial excess of atmospheric air to produce first combustion gases containing oxygen, said substantial excess of air amounting to between 2 and 2.5 times the minimum quantity of air theoretically required for complete burning of said first proportion of the fuel, (c) cooling said first combustion gases, (d) burning a second portion of fuel in the second combustion chamber using the cooled first combustion gases as the primary oxidizing medium, and (e) using the exhaust gases from the last combustion chamber in the heat-exchanger to preheat at least a portion of the atmospheric air for passage into at least one of the combustion chambers.

4. A method of burning fuel containing hydrocarbon compounds, comprising the following steps:

(a) providing at least a first and a second combustion chamber, a heat-exchanger, and atmospheric air for passage into at least one of the combustion chambers, (b) burning a first proportion of fuel in the first combustion chamber with a substantial excess of atmospheric air to produce first combustion gases containing oxygen, (c) cooling said first combustion gases, (d) burning a second portion of fuel in the second combustion chamber using the cooled first combustion gases as the primary oxidizing medium, and (e) using the exhaust gases from the last combustion chamber in the heat-exchanger to preheat at least a portion of the atmospheric air for passage into at least one of the combustion chambers, said atmospheric air being preheated to a temperature within the range 650° C. to 750° C. before passing into the first combustion chamber.

5. A method according to claim 4, wherein exhaust gases from the second combustion chamber are used in the heat-exchanger for preheating the atmospheric air.

6. A method according to claim 1, wherein all the combustion gases from the first combustion chamber are used as the oxidizing medium in the second combustion chamber.

7. A method of burning fuel containing hydrocarbon compounds, comprising the following steps:

(a) providing at least a first and a second combustion chamber, a heat-exchanger, and atmospheric air for passage into at least one of the combustion chambers, (b) burning a first proportion of fuel in the first combustion chamber with a substantial excess of atmospheric air to produce first combustion gases containing oxygen, (c) cooling said first combustion gases, (d) burning a second portion of fuel in the second combustion chamber using the cooled first combustion gases as the primary oxidizing medium, the combustion gases used as the oxidizing medium in the second combustion chamber containing free oxygen amounting to between 1.2 and 1.3 times the minimum quantity of oxygen theoretically required for complete burning of said second proportion of the fuel, and (e) using the exhaust gases from the last combustion chamber in the heat-exchanger to preheat at least a portion of the atmospheric air for passage into at least one of the combustion chambers.

8. An apparatus for burning fuel containing hydrocarbon compounds comprising in combination, means for producing a flow of atmospheric air, a first heat-exchanger for preheating said flow of air, a first combustion chamber with means for burning therein a first proportion of said fuel with a substantial excess of said air to produce first combustion gases containing oxygen, a second heat-exchanger for cooling said first combustion gases, a duct for conveying the cooled first combustion gases to a second combustion chamber, means for burning a second proportion of the fuel in the second combustion chamber using the cooled first combustion gases as the sole or substantially the sole oxidizing medium, a conduit for conveying exhaust gases from the second combustion chamber to the first heat-exchanger, and means for introducing into the two combustion chambers substantially equal mass flows of fluid fuel.

* * * * *